US009522544B2

(12) United States Patent
Campanini

(10) Patent No.: US 9,522,544 B2
(45) Date of Patent: Dec. 20, 2016

(54) THERMAL PRINTER HEAD WITH PRINT CONTROL DEVICES

(75) Inventor: Alberto Campanini, Fidenza (IT)

(73) Assignee: Custom S.p.A. (IT)

( * ) Notice: Subject to any disclaimer, the term of this patent is extended or adjusted under 35 U.S.C. 154(b) by 551 days.

(21) Appl. No.: 12/057,430

(22) Filed: Mar. 28, 2008

(65) Prior Publication Data

US 2008/0247799 A1 Oct. 9, 2008

(30) Foreign Application Priority Data

Apr. 3, 2007 (EP) ..... 07425198

(51) Int. Cl.
*B41J 2/32* (2006.01)
*B41J 2/355* (2006.01)

(52) U.S. Cl.
CPC ..... *B41J 2/355* (2013.01); *B41J 2202/37* (2013.01); *B41J 2202/38* (2013.01)

(58) Field of Classification Search
CPC .. B41J 2202/38; B41J 2209/3935; G07B 5/00; G07B 5/08; G07B 5/04
USPC ..... 400/120.01, 120.16; 347/197
See application file for complete search history.

(56) References Cited

U.S. PATENT DOCUMENTS 4,699,531 A * 10/1987 Ulinski et al. ..... 400/74
4,934,846 A 6/1990 Gilham
5,105,279 A * 4/1992 Kamada et al. ..... 358/296
5,835,232 A * 11/1998 Kameyama ..... 358/296
6,042,279 A * 3/2000 Ackley ..... 400/103
2005/0002049 A1* 1/2005 Chiu ..... 358/1.12
2005/0097066 A1 5/2005 Nambudiri
2005/0140770 A1* 6/2005 Kang et al. ..... 347/198
2005/0168562 A1 8/2005 Imai
2005/0219311 A1 10/2005 Sugahara
2007/0211099 A1* 9/2007 Lyons et al. ..... 347/16

FOREIGN PATENT DOCUMENTS

| | | | |
|---|---|---|---|
| AT | 107057 T | | 6/1994 |
| CA | 2485785 A1 | | 5/2005 |
| DE | 68915816 D1 | | 7/1994 |
| DE | 68915816 T2 | | 1/1995 |
| EP | 0 331 352 A2 | | 9/1989 |
| EP | 1 530 167 A | | 5/2005 |
| JP | 07329365 A | * | 12/1995 |
| JP | 1998-334286 | | 12/1998 |
| JP | 2003-115060 | | 4/2003 |

* cited by examiner

*Primary Examiner* — Leslie J Evanisko

(74) *Attorney, Agent, or Firm* — Laubscher, Spendlove & Laubscher, P.C.

(57) ABSTRACT

A thermal printer head and print control device capable of controlling what is printed onto a voucher, which includes a printer head and an image control sensor placed in an upper part of the printer head, and including an electronic card on a control unit and cables for connecting the image control sensor to the electronic card and the control unit.

5 Claims, 2 Drawing Sheets

THERMAL PRINTER HEAD WITH PRINT CONTROL DEVICES

BACKGROUND OF THE INVENTION

The invention is concerned with a printer which is capable of controlling the accuracy of material which is to be printed.

More particularly, the present invention is concerned with a printer which is responsive to the material which is to be printed and that is conveyed to a printer by a printer operator for printing or in response to any matter which is to be printed so that the printer will print that which was conveyed by the operator or in response to the matter transmitted to the printer for printing. Controlling the accuracy of material which is to be printed is of primary importance in particular for the printing of tickets and vouchers so that there is substantially always complete control of that which is to be printed to produce a final printed product. This type of control forms a primary part and purpose of the invention, and this controlling of the accuracy of the material which is to be printed is not left to control of an operator.

DESCRIPTION OF RELATED ART

Thermal head printers and control devices for thermal head printers heretofore known which provide a paper roll onto which tickets or vouchers or similar material are to be printed for providing a finished and useable printed product are generally associated with electronic and electrical components which are controlled by various software.

Present day thermal printers which are used for printing vouchers or tickets or equivalent items are now controlled by an operator. Also, printers which use a paper roll have a main use in the commercial sector, and are primarily used to print vouchers or receipts for the purchase of goods or items of the type to be consumed. Control by the operator is not perfect because it involves a human element, and operator control can result in unforeseen errors.

At present with present day technology in the field of thermal head printers, there is no immediate control by the operator to assure that the printer will print a correct version of the ticket or voucher or receipt. In a similar manner, should the customer or individual who receives the voucher, ticket or receipt perceive that there is a problem or error with the item, it may not be possible for the operator to control or correct the printers and automatic machines associated therewith and correct the problem or correct the error, and this can result in a dissatisfied customer or individual. In fact, it may not be possible to verify that the voucher corresponds to a certain product, to a certain service or to a certain right. Moreover, considering other forms of possible use of the printed voucher or printed ticket, there may be differences from the image or item at the originating point that is intended to be printed, thereby producing an incorrect version.

For example, in a situation where the use of the item or voucher or ticket or receipt is intended for a lottery, extreme accuracy is necessary to be certain that there is no duplication in anything pertaining to whom would be the correct recipient or winner, and it is important that all printed material on each item is exactly the same and in conformity with each other except that which is necessary to distinguish one item from another so as to render each item unique. Specifically, it is necessary that information, such as the date of maturity of a guarantee, or requirements as to a particular form of payment or having information about the goods or services to be rendered or product information or information which is of benefit to the user or seller, as well as problems which may arise for each control of that which is to be printed, and an incorrect printing regardless of how minor can also have legal consequences for the seller or for the buyer or for both. Basically, to assure accuracy for all types of information, present day technology has been found to be wanting. With present technology, it is generally not possible for an operator to determine when there is an error or problem with the printing head or possibly other parts of the printing machine while printing is taking place, or to determine when a voucher is complete. In order to assure accuracy, an operator must be able to verify when a voucher corresponds to a certain product, and this may be subject to human error. With the present invention, it is possible for the printer mechanism to be self-checking for accuracy of what is to be printed, and there is no requirement that the operator or another do any type of proof reading.

A feature of the invention is to achieve a high standard of security with respect to the correctness of what is printed onto the voucher.

For this purpose the present invention provides for a control for printers which essentially includes a control sensor capable of reading the printing or other information and to transform the printing or information read by the print head into electric or electronic pulses of the same type as that sent to and read by the sensor and with a connection of the sensor and of the print head to the control unit.

A primary feature of the present invention and principle purpose or aim of the present invention is to create a printer capable of automatically controlling the accuracy of what is printed and, consequently, to control or assure that which is printed will correspond directly and exactly to what is sent to the printer by what an individual inputs or that which is automatically sent to the printer.

Another feature of the invention is to remove control from a human and provide for automatic self control of the printer.

As will be appreciated from a reading of the description, it will become evident that the present invention has advantages over the presently existing prior art.

The inventor of this application also has patents and patent applications in this or a related field of technology, and these patents and patent applications are as follows:

- U.S. Pat. No. 6,798,436, issued: Sep. 28, 2004, on U.S. patent application Ser. No. 10/147,174, Filed: May 8, 2002; title: THERMAL PRINTER CLOSING APPARATUS
- U.S. Pat. No. 7,175,356, issued: Feb. 13, 2007, on U.S. patent application Ser. No. 10/939,043, Filed: Sep. 10, 2004, title: HEAD SUPPORT BASE FOR THERMAL PRINTER
- U.S. patent application Ser. No. 11/193,214, Filed: Jul. 29, 2005, title: ANTIJAMMING DEVICE FOR PRINTERS PUT IN PUBLIC PLACES
- U.S. patent application Ser. No. 11/581,880, Filed: Oct. 16, 2006, title: AUTOMATIC OPENING DEVICE FOR THE PAPER LOADING INTO THE PRINTERS
- U.S. patent application Ser. No. 10/147,174, Filed: May 8, 2002, title: THERMAL PRINTER CLOSING APPARATUS
- U.S. patent application Ser. No. 10/939,044, Filed: Sep. 9, 2004, title: HEAD SUPPORT BASE FOR THERMAL PRINTER.
- U.S. patent application Ser. No. 11/272,277, Filed: Nov. 10, 2005, title: LASER WRITING HEAD FOR PRINTER.

U.S. patent application Ser. No. 11/193,214, Filed: Jul. 29, 2005, title: ANTIJAMMING DEVICE FOR PRINTERS PUT IN PUBLIC PLACES.

BRIEF SUMMARY OF THE INVENTION

To these ends, the invention consists in the provision of a thermal printer head and a print control device capable of controlling the material which is printed onto a voucher, and includes a printer head, and an image control sensor placed or located in an upper part of the printer head.

The thermal printer head and print control device include an electronic card positioned or located on a control unit; together with cables for connecting the image control sensor to the electronic card and the control unit. The electronic card is connected by means of a cable to the control unit. The cable connects the control unit to the image control sensor and to the printer head.

A retroactive control chain is also provided which includes the image control sensor, printer head, cables, electronic card and control unit.

DETAILED DESCRIPTION

Figure 1:
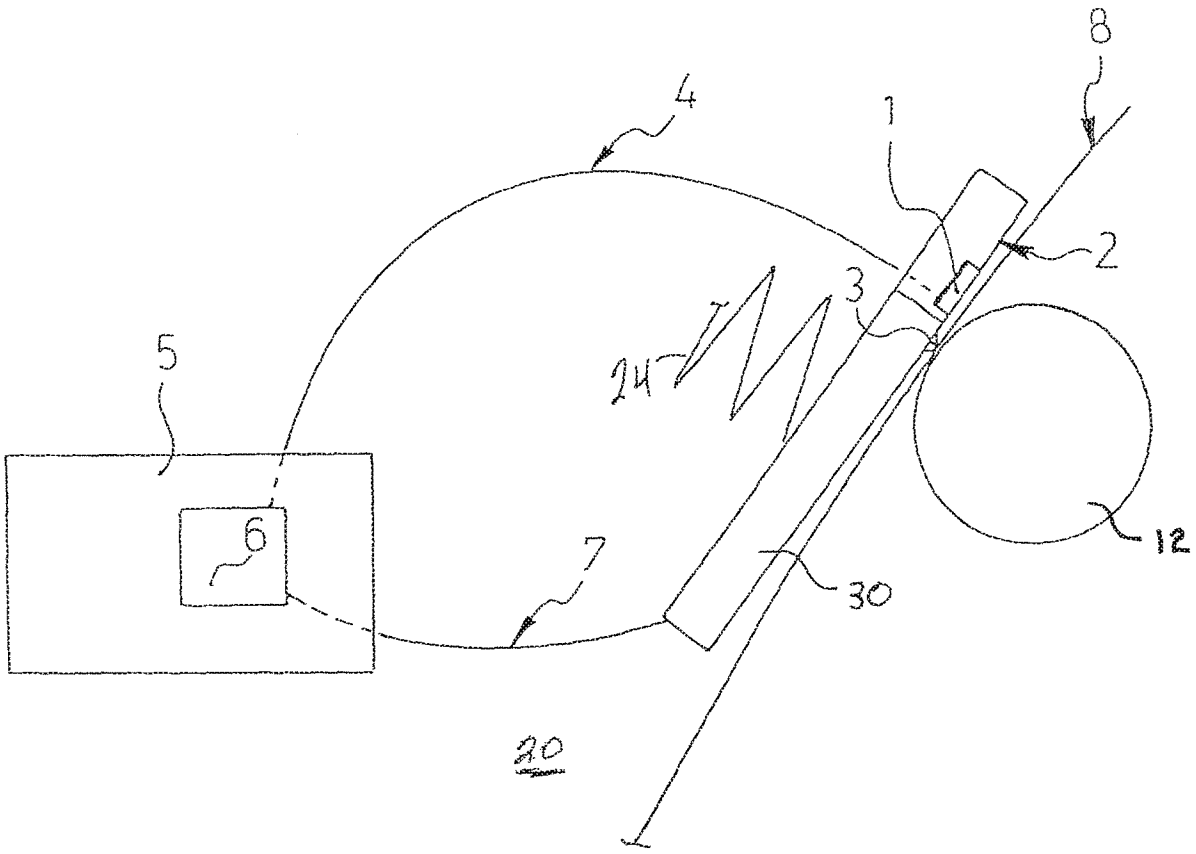
FIG. 1 is a schematic layout of the invention which includes a printer head and a control unit shown schematically.

Referring now more particularly to the drawings which illustrate the best mode presently contemplated for carrying out the invention, in which the same or like reference numerals throughout represent the same parts.

Thermal printer 20 includes a printer head 3 and an image control sensor 1 located in an upper part of printer head 3.

Figure 2:
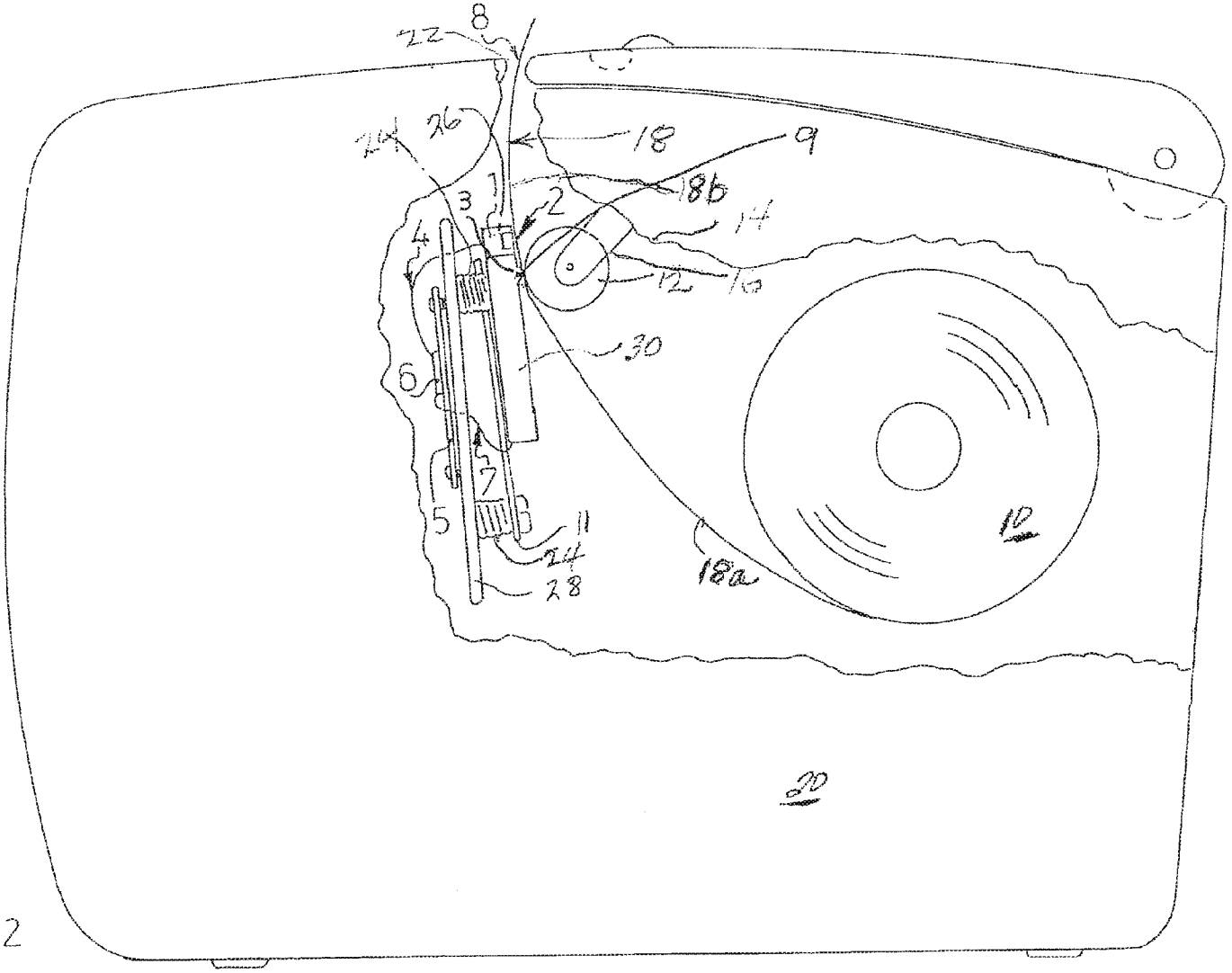
FIG. 2 is a lateral view, with details known to the prior art omitted for the sake of clarity and a print control device for a roll printer capable of and usable for dispensing vouchers, receipts and other indicia requiring accuracy of information printed thereon.

FIGS. 1 and 2 as noted, illustrate the best mode for carrying out the invention, thermal printer 20 (FIG. 2) is shown which generally includes a paper supply or paper roll 10 and a printer mechanism 30.

Printer mechanism 30 includes printer head 3 positioned juxtaposed to a rotatable roller 12. Vouchers 8 are derived from blank paper generally designated 18 carried by paper roll 10. Paper 18 is conventionally supplied from paper roll 10 and is moved between rotatable roller 12 and printer head 3 and includes paper portion 18*a* and paper portion 18*b* and a printer head prints onto blank paper 18 to form voucher 8 having printing thereon to form the printed voucher on printed portion 18*b*. Paper portion 18*a* leaves paper roll 10 and passes between printer head 3 and rotatable roller or printing alignment roller 12 and after printing takes place forms the printed paper voucher 18*b*.

Rotatable roller 12 functions as an alignment roller and is fixed in position relative to chassis 14 of thermal printer 20 by roll holder or bracket 16 and is positioned juxtaposed to image control sensor 1 to permit paper portion 18*a* of paper 18 to pass between sensing portion defined by protrusion 9 or raised position forming printer head 3. Roller 12 maintains paper 18 in contact with protrusion 9 as it passes between printer mechanism 30 and roller 13.

Thermal printer 20 is provided with an exit opening 22 through which the printed paper portion 18*b* which now forms voucher 8 for exiting through exit opening 22. A conventional cutter (not shown) for cutting paper portion 18*b* to complete the formation of voucher 8 is provided at exit opening 22.

Printer mechanism 30 includes a pair of springs 24 for holding printer head 3 juxtaposed to roller 12 while having sufficient flexibility and resilience to permit paper 18 to pass between printer head 3 and roller 12. A spring 24 is provided at each end of a support 28 for the electronic card 5 and between a plate 11 of the printer mechanism 30. Springs 24 are provided to cause printer head to be held in its juxtaposed position next to roller 12 with paper 18 therebetween. Electronic card 5 includes, as part of its structure, control unit 6, and cables 4 are connected directly to control unit 6. Springs 24 are positioned between electronic card support 28 and printer mechanism 30. Springs 24 hold printer head protrusion 9 juxtaposed to paper alignment roller 12.

Printer mechanism 30 includes image control sensor 1 housed in the upper part 2 of image control sensor housing 26 of printer head 3 for positioning to read what is printed onto voucher 8 after voucher 8 passes between printer head 3 and rotatable roller 12. It should be noted that paper 18 comprises two portions, a first or unprinted paper portion 18*a* and a second or printed paper portion 18*b* which becomes voucher 8 after passing printing head 3.

Printer mechanism 30 is associated with image control sensor 1 for sensing the image or the printing which is printed onto voucher 8 after unprinted or clear paper portion 18*a* passes between rotatable roller 12 and printer head 3 for printing onto paper 18 to produce voucher 8 or printed portion 18*b*.

The electronic card 5 is provided to record the material which is printed onto voucher 8 as read by the image control sensor 1, and for this purpose the cables or other transmitting devices 4 are provided to transmit what the image control sensor 1 reads on to electronic card 5. Electronic card 5 includes control unit 6 and the cables 4 are connected directly from image control sensor 1 to electronic control unit 6. In addition, another set of cables or transmitting devices 7 is provided to transmit information from the printer mechanism 30 to control unit 6 indicating that which printer mechanism 30 is transmitting to printer head 3 for printing onto paper 18 to form voucher 8 or paper printed portion 18*b*. Cables 7 are connected directly between control unit 6 and printer mechanism 30. Electronic card 5 and control unit compare the electronic information delivered printer head 3 and received from the image control sensor 1. Preferably, control unit 6 compares the electronic information in the electronic card 5 received from image control sensor 1 and printer head 3 to ascertain whether the information printed onto paper printed portion 18*b* to form voucher 8 is the same exact electronic information from the printer head. Accordingly, a comparison is made to assure authenticity of the resultant printed material or voucher without any intervention on the part of an operator.

Control unit 6 reads what electronic information used by the printer head 3 onto paper 18 to form voucher 8 and is responsive to what is printed onto voucher 8. If what is printed onto voucher 8 is not correct or exactly (completely commensurate in scope) what is intended to be printed onto paper portion 18*a* to form paper printed portion 18*b*, image control sensor 1 stops any movement of paper 18 as well as printed voucher 8 and the printing operation is stopped to wait for a technician to arrive to correct the printer and the printing operation. The image control sensor 1 does two things: it first reads what is printed onto voucher 8, and if what is printed is inaccurate as determined by the control unit, the image control sensor also stops the printing operation until a technician can correct the problem with the Apparatus.

A retroactive control chain is provided which includes the components of the image control sensor 1, the printer head 3, the cables 4, 7, the electronic card 5 and the control unit 6. The image control sensor and the control unit cooperate to guarantee or assure the conformity of each printed voucher 8.

Electronic card 5 and springs 24 are positioned on support 28 which is fixed to chassis 14.

Plate 11 carries printer mechanism 30 and is spaced from support 28 by springs 24. Springs 24 maintain printer head 3 in alignment with roller 12

The invented device is possible to provide a number of changes and variations all coming within the scope of the present invention. Moreover, all of the individual components are interchangeable with other equivalent structure.

A schematic voucher or ticket printing device 10 schematically illustrated in FIG. 2 is provided with a conventional paper dispensing roll 12 for dispensing material or paper 18 onto which a voucher 8 is to be printed and withdrawn through exit opening 16 after printing thereon with a printer head 3.

DESCRIPTION OF OPERATION

The image control sensor 1, which is located in the upper part 2 of printer head 3, is connected, by means of cables 4, to electronic card 5 which includes control unit 6. Electronic card 5 and control unit 6 are connected by means of cable 7 to printer head 3 for reading into control unit 6 that which is printed onto voucher 8 by the printer head 3. The printer head is or can be actuated to check what is printed onto voucher 8 by comparison electronic components forming part of the control unit 6 to compare the material with that which is sent by the operator to the printer head in response to commands or through defined elaborations in the case of automatic operation.

Image control sensor 1 is situated in an upper part 2 of printer head 3, and the paper or voucher back-up roller 12 is positioned juxtaposed to the printer head 3. The paper 18 from which voucher is formed is dispensed from a conventional paper or voucher paper roll 10 which carries paper 18 from which vouchers are eventually derived (see FIG. 2) and is moved between paper alignment roll 12 for holding paper 18 adjacent to printer head 3 as paper 18 is transported to exit opening 22 at which point it is cut to form voucher 8. Paper alignment roller 12 is carried or supported by roller holder 16 and for holding roller 12 against printer head 3 and in alignment with printer head 3 while roller 12 permits paper 18 to pass between and move between roller 12 and printer head 3.

In this way, the control unit is able to compare that which is transmitted to printer head 3 and that which is actually printed onto voucher 8. In the situation in which the invention controls and is intended for accuracy, comparison is made so that when that which is actually printed onto voucher 8 does not correspond to what is transmitted to the printer head, then this inaccuracy or error is pointed out to image control sensor 1 which is connected to the unit control 6 and stamping or printing is stopped and the printing operation is actuated again or restarted, or the printing is stopped to wait for a repair technician or to wait for a new impulse to start automatically and provide diagnosis of the printing components.

In a working phase, the invention provides for the printing of the voucher to be restarted and printing to take place onto the voucher 8 and to print head 3. The subsequent control of image control sensor 1 is placed into the kinematics chain after print head 3, i.e. placed in such a way so that it can control what is printed. After receiving what is printed, the impulses generated are transmitted from image control sensor 1 by cable 4 from the electronic card 5 which arrive at the control unit 6. Control unit 6 compares the impulses sent to the electronic card 5 with the impulses with the pulses sent the printer head 3 which is actuated by the conformity control with what is defined during the print setting out.

A schematic voucher or ticket printing device 10 schematically illustrated in FIG. 2 is provided with a conventional paper dispensing roll 12 for dispensing material or paper 18 onto which a voucher 8 is to be printed and withdrawn through exit opening 16 after printing thereon by printer head 3.

Paper or material 18 is conventionally conveyed past printer head 3 between back-up roller 12 and printer head 3. Back-up roller 12 is held to chassis 14 of printer device 20 by means of a conventional back-up roll holder in cooperation with spring 24.

In order that this disclosure will be complete in all respects, the subject matter of inventor's prior applications and patents are incorporated herein by references as if actually written and contained in this application.

While there has been shown and described what is considered to be the preferred embodiments, it will be obvious to those skilled in the art that various changes and modifications may be made without departing from the scope of the invention.

The invention claimed is:

1. A thermal printer for printing on a voucher, comprising (a) a printer mechanism including an upper portion for generating print electronic information;

(b) a thermal printer head connected with one side of said printer mechanism upper portion for printing an image on one surface of the voucher in accordance with said print electronic information;

(c) an alignment roller arranged spaced from and opposite said thermal printer head, the voucher passing between said alignment roller and said thermal printer head;

(d) an image sensor arranged on said one side of said printer mechanism upper portion adjacent to and downstream from said thermal printer head for reading the image printed on the voucher surface by said thermal printer head and transforming said read image into actual electronic information corresponding with the read image;

(e) a spring connected with said printer mechanism on a side opposite said one side for biasing said printer mechanism in the direction of said alignment roller and said thermal printer head into contact with the voucher and said image sensor adjacent the voucher; and (f) a print control unit connected with said printer mechanism and with said image sensor for comparing said print electronic information with said actual electronic information, said print control unit stopping printing when said actual electronic information differs from said print electronic information.

2. The thermal printer of claim 1, and further comprising an electronic card electronically connected with said print control unit, a cable for connecting said image sensor with said electronic card, and a cable for connecting said electronic card with said thermal printer head.

3. The thermal printer of claim 2, and further including a retroactive control chain comprising said image sensor, said thermal printer head, said cables, said electronic card and said print control unit.

4. The thermal printer of claim 3, and further including a support for carrying said spring and urging said thermal printer head for engagement with paper to be printed to form the voucher as the paper passes between said alignment roller and said thermal printer head.

5. The thermal printer of claim 4, wherein said electronic card and said control unit are supported on said support.

* * * * *